US006223738B1

(12) United States Patent
Wu

(10) Patent No.: US 6,223,738 B1
(45) Date of Patent: May 1, 2001

(54) PORTABLE BURNER

(76) Inventor: Tsen-Tung Wu, No. 25, Lane 93, Niupou S. Rd., Hsinchu City (TW)

( * ) Notice: Subject to any disclaimer, the term of this patent is extended or adjusted under 35 U.S.C. 154(b) by 0 days.

(21) Appl. No.: 09/649,248

(22) Filed: Aug. 28, 2000

(51) Int. Cl.[7] ..... F24C 5/20
(52) U.S. Cl. ..... 126/38; 126/9 R; 431/344
(58) Field of Search ..... 126/9 R, 38, 39 R, 126/41 R, 39 B, 9 A, 9 C, 44; 431/264, 344, 258, 247

(56) References Cited

U.S. PATENT DOCUMENTS 3,648,680 * 3/1972 Hein ..... 126/38
4,192,284 * 3/1980 Vache ..... 126/9 R
4,284,058 * 8/1981 Lutz ..... 126/9 R
4,904,182 * 2/1990 Leshner ..... 126/38
5,370,527 * 12/1994 Hefling et al. ..... 126/38

* cited by examiner

*Primary Examiner*—James C. Yeung
(74) *Attorney, Agent, or Firm*—Woodcock Washburn Kurtz Mackiewicz & Norris LLP

(57) ABSTRACT

A portable burner has a base with an electrical lighter and a nozzle provided with an inlet and multiple outlets, a gas pipe retrievable received in the base and having a removable connector adapted to connect to a gas source, a support snugly located on top of the base to encase the electrical lighter in the base and having at least three ledges and at least three bosses oppositely formed in relation to the ledges and a cover encasing the support and the gas pipe in the base and having at least two protrusions formed to correspond to at least two keyholes in the bottom face of the base.

4 Claims, 6 Drawing Sheets

PORTABLE BURNER

BACKGROUND OF THE INVENTION

1. Field of the Invention

The present invention relates to a portable burner, and more particularly to a portable burner with easy assembly/disassembly characteristics. The portable burner is able to be disassembled and reassembled in a compact manner for storage.

2. Description of Related Art

During holidays, weekends, families often go suburbs for relaxation or just have a barbecue (B.B.Q) in one's own backyard. In doing such an activity, there is one thing that cannot be left out and is quite handy when required; a portable burner. A conventional portable bumer has legs to support a base provided with an electrical lighter, a gas pipe and a nozzle and a support adapted to be seated on top of the base to withstand the weight of a pot on top of the support. Because the legs are fixedly mounted under the base and the gas pipe extends out directly from the nozzle, even when the portable burner is disassembled for storage, the portable burner still occupies a large space, which is not easy for the user to handle before or after usage.

To overcome the shortcomings, the present invention tends to provide an improved portable burner to mitigate and obviate the aforementioned problems.

SUMMARY OF THE INVENTION

The main objective of the invention is to provide an improved portable burner having a base, a gas pipe detachably connected to the base, a support snugly seated on top of the base and a cover detachably encasing the support and the gas pipe in the base and detachably engaged with the base so as to become a stabilizer when in use.

Another objective of the invention is that the portable burner is able to be disassembled and reassembled all the parts in the base and covered with the cover to become a compact manner for easy storage.

Other objects, advantages and novel features of the invention will become more apparent from the following detailed description when taken in conjunction with the accompanying drawings.

DETAILED DESCRIPTION OF PREFERRED EMBODIMENT

Figure 1:
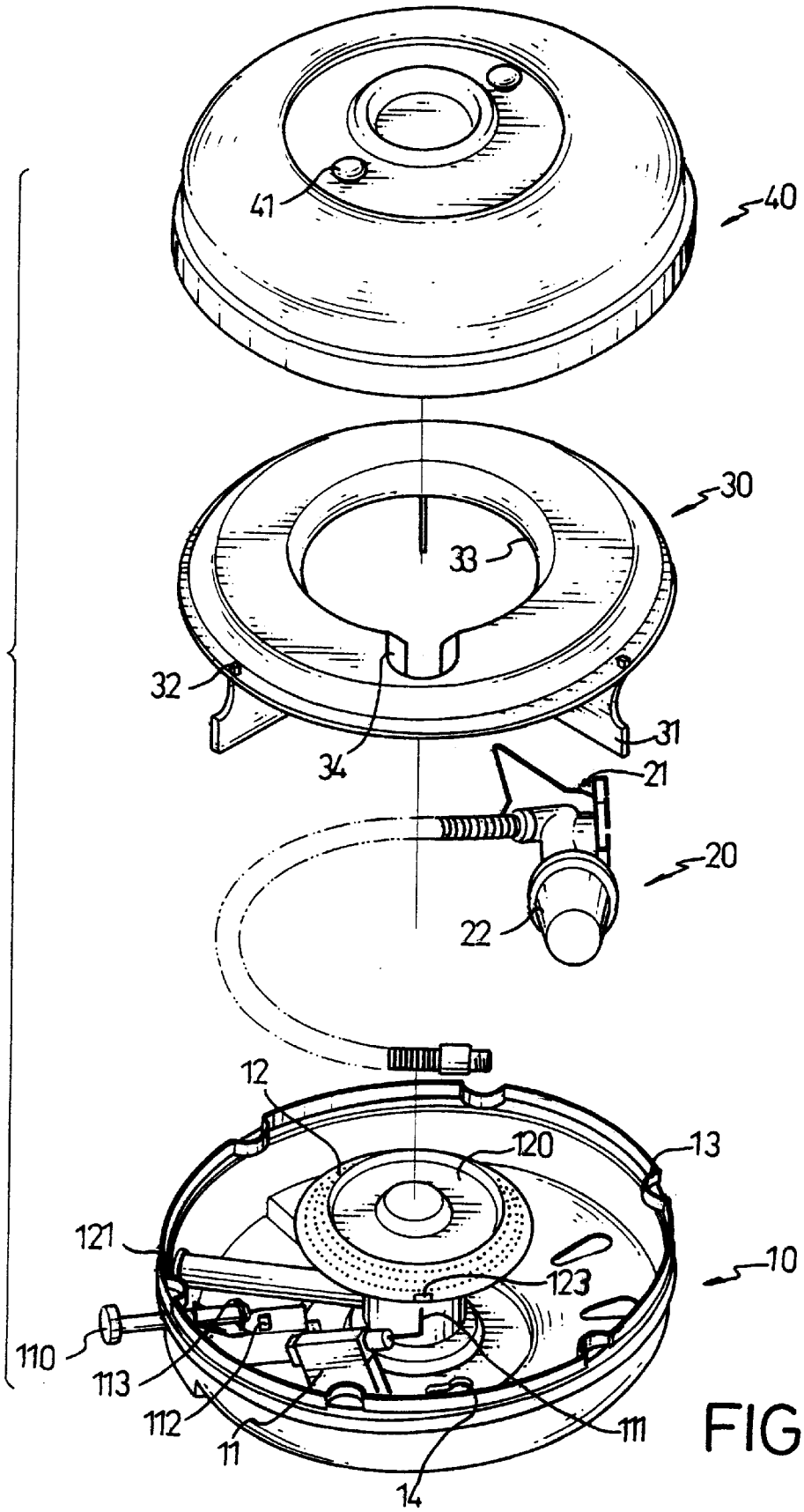
FIG. 1 is an exploded perspective view showing the portable burner constructed in accordance with the present invention.
Figure 2:
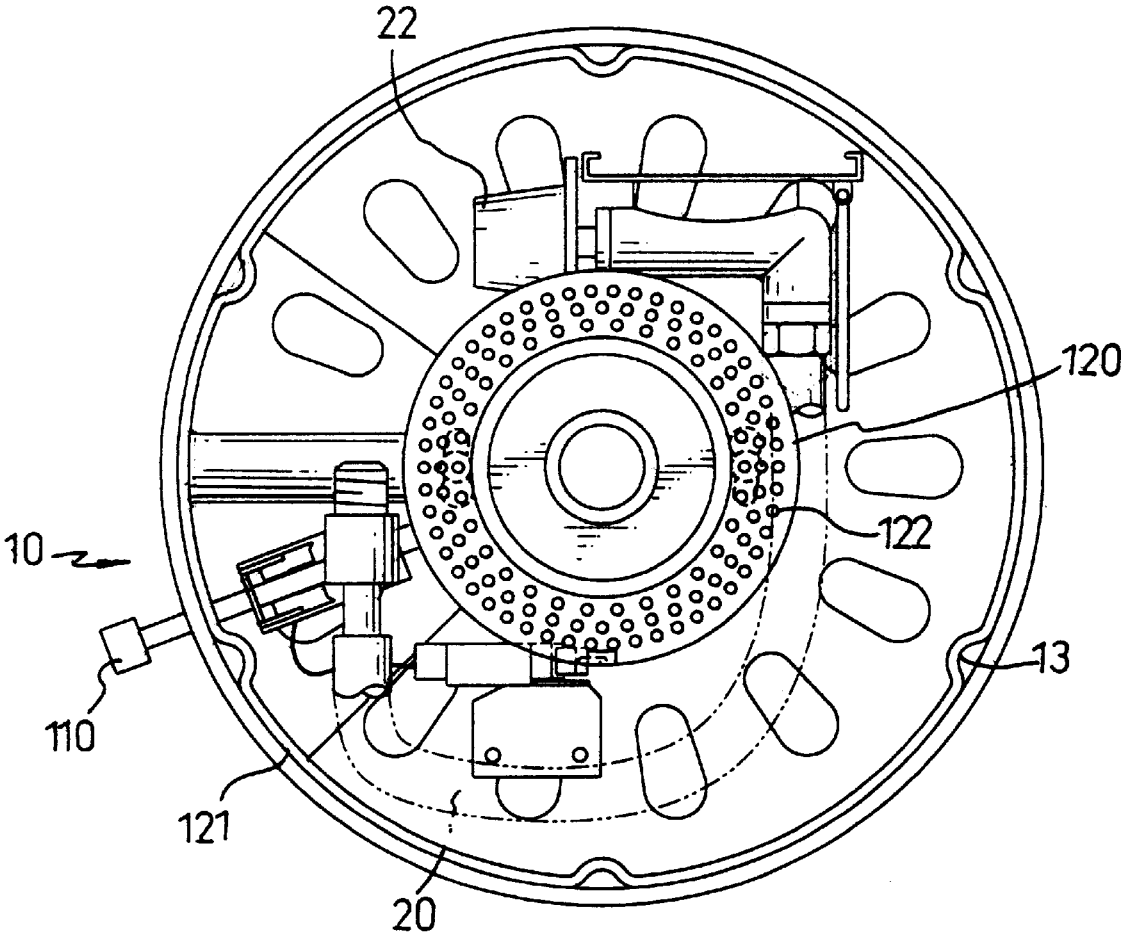
FIG. 2 is a top plan view showing the displacement of the gas pipe received in the base for storage.

Referring to FIGS. 1 and 2, a portable burner constructed in accordance with the present invention has a base (10), a gas pipe (20), a support (30) and a cover (40).

The base (10) has an electrical lighter (11), a nozzle (12) with an inlet (120) and a housing (120) in communication with the inlet (120) and having multiple outlets (122). The electrical lighter (11) has a handle (110) extendable from the base (10) and a pilot (111) located near a notch (123) in the housing (120).

Figure 3:
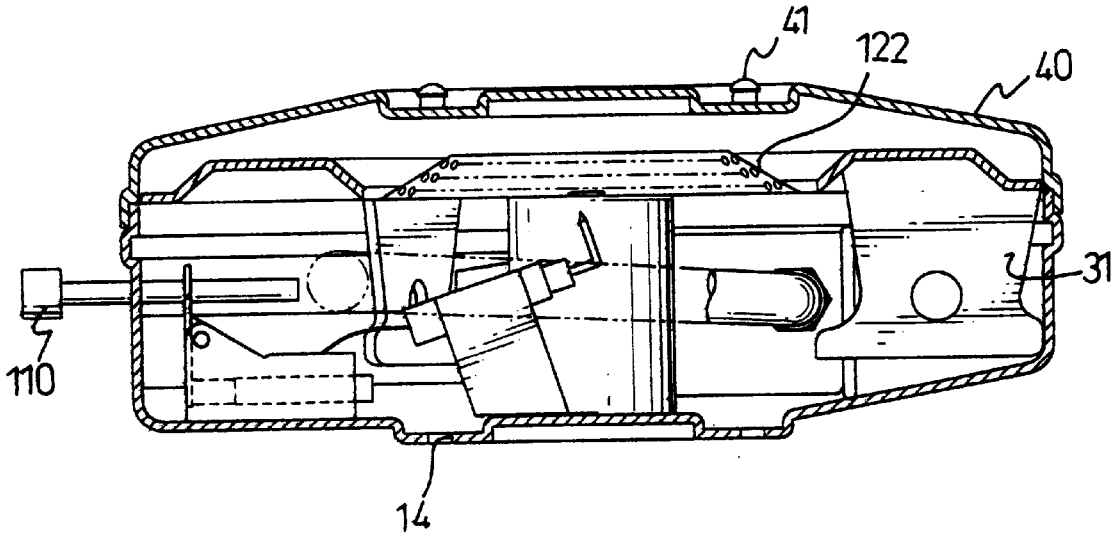
FIG. 3 is a side plan view of the assembled portable burner for storage, wherein the base and the cover are shown in cross section.

The gas pipe (20) is retrievable received in the base (10), as shown in FIGS. 2 and 3 and has a connector (21) detachably mounted at a first end of the gas pipe (20) and adapted to connect to a gas source and a second end of the gas pipe (20) being connected to the inlet (121) of the base (10) and a knob (22) mounted to adjust the volume flowing through the gas pipe (20).

The circular support (30) has at least three ledges (31), at least three bosses (32) formed on opposed side face in relation to the ledges (31) and corresponding to at least three recesses (13), a central opening (33) defined to correspond to the housing (120) and a cutout (34) defined in a circumference defining the central opening (33) and corresponding to the pilot (111).

The cover (40) detachably engages with the base (10) to encase the support (30) and the gas pipe (20) in the base (10) and has at least two protrusions (41) oppositely formed to correspond to at least two keyholes (14) in the bottom face of the base (10).

With reference to FIG. 3, it is noted that when the portable burner of the invention is assembled for storage, all the elements are snugly received between the base (10) and the cover (40), such that the user is able to carry the burner easily. Furthermore, the burner, when assembled for storage is compact so as to enable the user to store it in a limited space.

Figure 4:
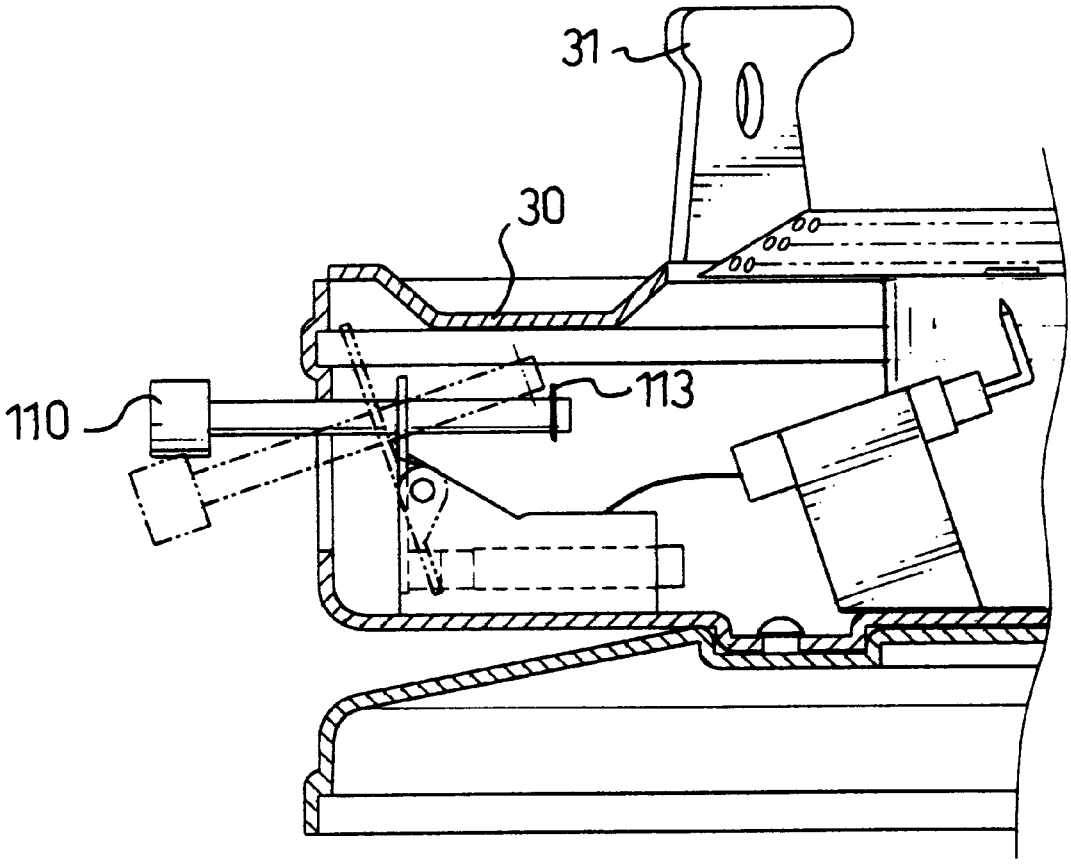
FIG. 4 is a schematic view showing the movement of the electrical lighter.

Referring back to FIG. 1 and taking reference to FIG. 4, the electrical lighter (11) further has a slit (112) and the handle (110) has a C clip (113), such that when the handle (110) is received in the base (10), the C clip (113) of the handle (110) is received in the slit (112) to place the handle (110) in position. When the burner of the invention is in use, the user just slightly lifts the handle (110) to allow the C clip (113) to leave the limitation from the slit (112), then the handle (110) is able to function normally.

Figure 5:
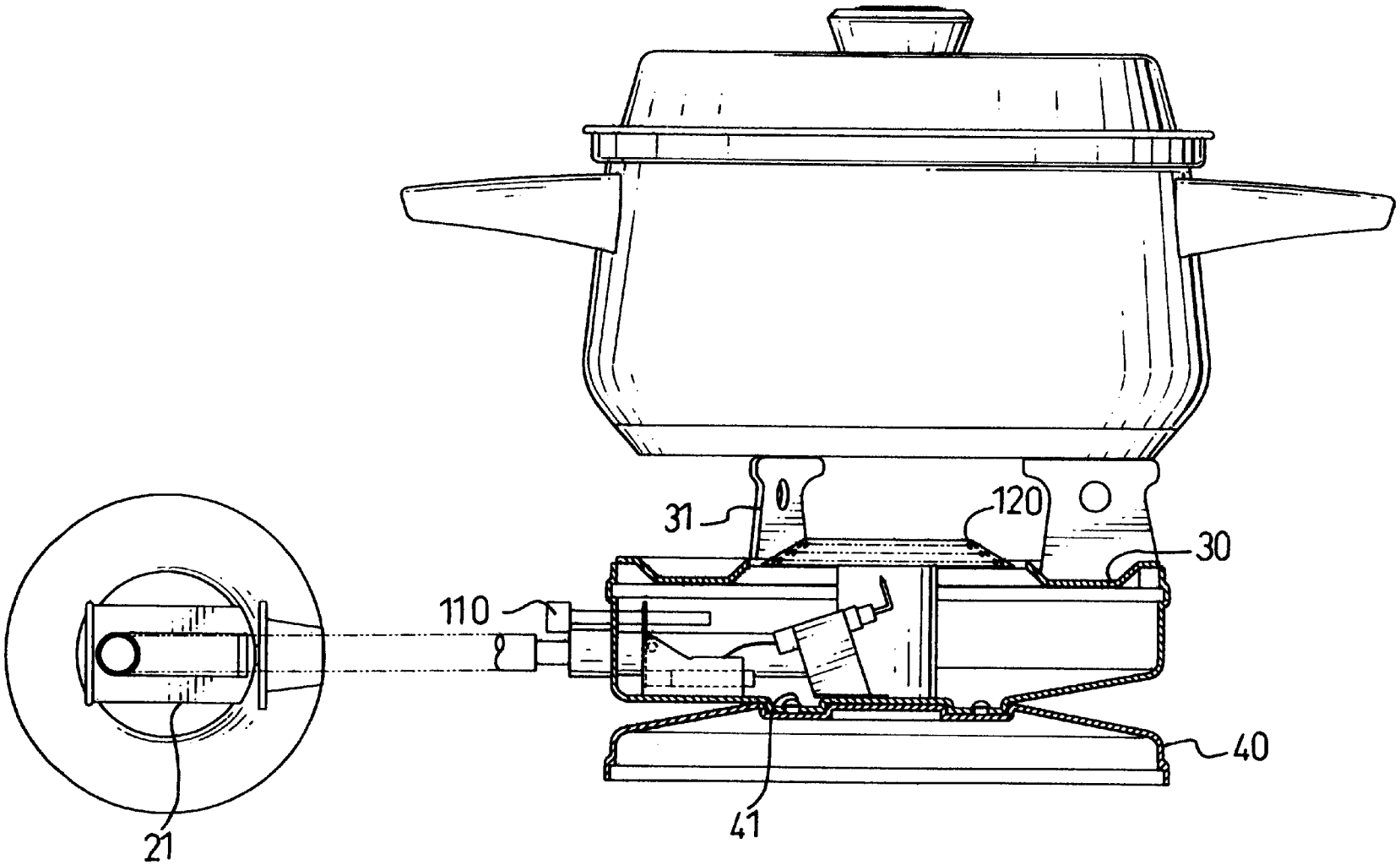
FIG. 5 is a schematic view showing the portable burner of the invention is operated by using a gas can.
Figure 6:
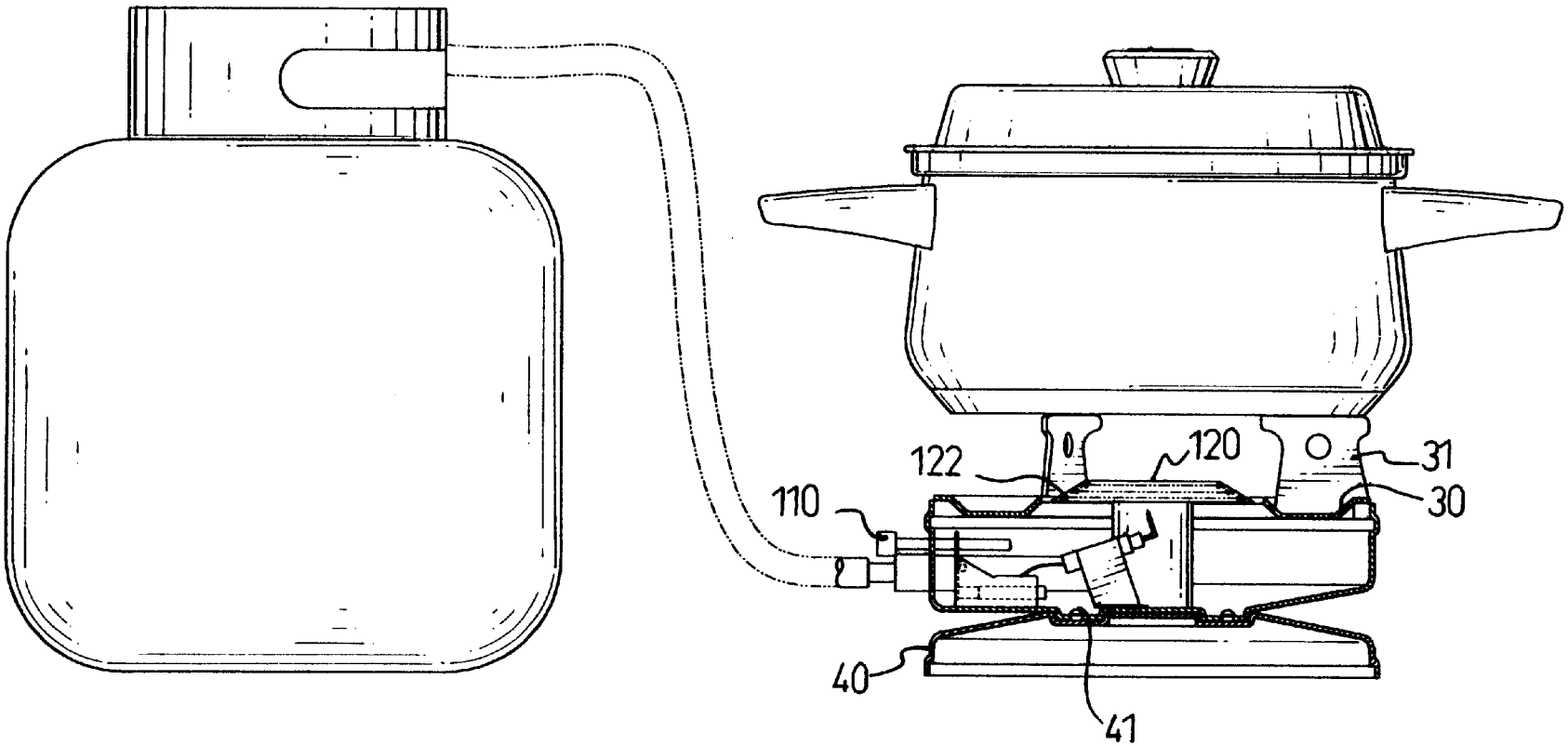
FIG. 6 is a schematic view showing the portable burner of the invention is operated by using a gas tank.

With reference to FIGS. 4, 5 and 6, when the portable burner of the invention is in use, the user first takes all movable elements out from the base (10) and then reverses the cover to allow the protrusions (41) of the cover (40) to be received in the keyholes (14) of the base (10), such that after the cover (40) is connected to the base through the engagement between the protrusions (41) and the keyholes (14), the cover (40) functions as a stabilizer to enable the user to use the burner steadily.

Thereafter, the second end of the gas pipe (20) is connected to the inlet (121) of the base (10) and the support (30) is reversed to seat the bosses (32) in the corresponding recesses (13) of the base. In this arrangement, the support (30) is positioned on top of the base (10) and the ledges (31) extending out from the support provide a sufficient support to a pot located on the top. It is noted that the cutout (34) aligns with the pilot (111), such that when the gas in the burner is initially lit, the support (30) will not easily be damaged after a long period of time using it.

After the burner is assembled, the user is able to connect the burner to a gas can by means of the connector (21) or the user is able to connect the burner directly to a gas tank by directly connecting the first end of the gas pipe (20) to the gas tank without the help of the connector (21).

It is concluded that the portable burner of the invention has the following advantages:

1. portable;

2. compact;

3. light weight; and 4. easy to maintain.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable burner comprising:

a base having an electrical lighter with a handle extendable from the base and a pilot and a nozzle with a housing provided with an inlet and multiple outlets:

a gas pipe retrievable from the base and having a first end with a removable connector adapted to detachably connect to a gas source and a second end detachably connected to the inlet of the base;

a support snugly located on top of the base to encase the gas pipe in the base and having least three ledges configured to provide support to a pot, a central opening defined to correspond to the nozzle of the base and a cutout defined in a circumference defining the central opening to correspond to the pilot; and a cover located on top of the base to encase the support and the gas pipe in the base and having at least two protrusions formed on a top face to correspond to at least two keyholes defined in a bottom face of the base so as to function as a stabilizer when assembled with the base.

2. The portable burner as claimed in claim 1, wherein the housing has a notch defined to correspond to the pilot.

3. The portable burner as claimed in claim 2, wherein the support has at least three bosses formed oppositely to the ledges and the base has at least three recesses defined to correspond to the bosses;

whereby when the support is reversed and located on top of the base with the bosses received in the recesses, the support is positioned on top of the base.

4. The portable burner as claimed in claim 3, wherein the electrical lighter further has a slit and the handle has a C clip formed to correspond to the slit thereby allowing the C clip to be received in the slit when the portable burner is assembled for storage.

* * * * *